United States Patent [19]

Wing et al.

[11] Patent Number: 4,646,913

[45] Date of Patent: Mar. 3, 1987

[54] KEY PACK

[76] Inventors: Russell T. Wing; David H. Palmer, both of 20050 Lakeview Ave., Deephaven, Minn. 55331

[21] Appl. No.: 728,524

[22] Filed: Apr. 29, 1985

Related U.S. Application Data

[63] Continuation-in-part of Ser. No. 518,408, Jul. 29, 1983, abandoned.

[51] Int. Cl.[4] ..... A45C 11/32; A47G 29/10

[52] U.S. Cl. ..... 206/37.2; 206/37.3; 206/37.6; 206/37.8; 70/408; 70/456 R

[58] Field of Search ..... 206/37, 37.1–37.8, 206/38, 38.1; 70/408, 456 R, 457, 460; 30/158

[56] References Cited

U.S. PATENT DOCUMENTS

| | | | |
|---|---|---|---|
| 616,689 | 12/1898 | Ruettgers | 30/158 |
| 2,295,123 | 9/1942 | Mudrich | 70/456 R |
| 2,371,308 | 3/1945 | Mosch | 206/38 |
| 2,402,347 | 6/1946 | Rotheraine | 70/456 R |
| 2,611,260 | 9/1952 | Pontin | 70/456 R |
| 2,618,958 | 11/1952 | Goodson | 70/456 R |
| 2,695,511 | 11/1954 | Wing et al. | 70/456 R |
| 2,696,101 | 12/1954 | Dysart | 70/456 R |
| 2,753,710 | 7/1956 | Bestard | 70/456 R |
| 3,147,609 | 9/1964 | Ryan | 70/456 R |
| 3,263,464 | 8/1966 | Campbell | 70/456 R |
| 3,457,746 | 7/1969 | Glassman | 70/408 X |
| 3,618,346 | 11/1971 | Humphrey | 70/408 |
| 4,045,984 | 9/1977 | McDonald | 70/456 R |

FOREIGN PATENT DOCUMENTS

| | | | |
|---|---|---|---|
| 482277 | 4/1952 | Canada | 70/456 R |

*Primary Examiner*—William Price
*Assistant Examiner*—Sue A. Weaver
*Attorney, Agent, or Firm*—Kinney & Lange

[57] ABSTRACT

A key holder is for keys with standardized heads of about the same width as standard key blades. The key holder includes a casing which has a flat base wall and a plurality of parallel, spaced-apart, elongated key compartment side walls extending integrally upwardly from the base wall to form a plurality of parallel key compartments. Keys are pivotally mounted in outer end portions of the key compartment side walls on removable cap screws and are pivotable about openings in the key heads and these cap screws from storage position inside of the casing to position for use of the key outside of the casing. Leaf springs, one in each key compartment, push the keys against the side walls with sufficient force to frictionally hold the keys in place each within its own key compartment whether or not one or the other of the cap screws is temporarily removed to insert or remove other keys. Each leaf spring also exerts sufficient force against its key to frictionally hold the key in whatever position the key is positioned by the user. Key movement fingers, one in each key compartment, are pivotally mounted about their center portions in position where upward movement of only one end of only one such finger will access only one key to move it from the storage position to a position where it can be accessed manually and pivoted out for use.

4 Claims, 9 Drawing Figures

FIG. 4
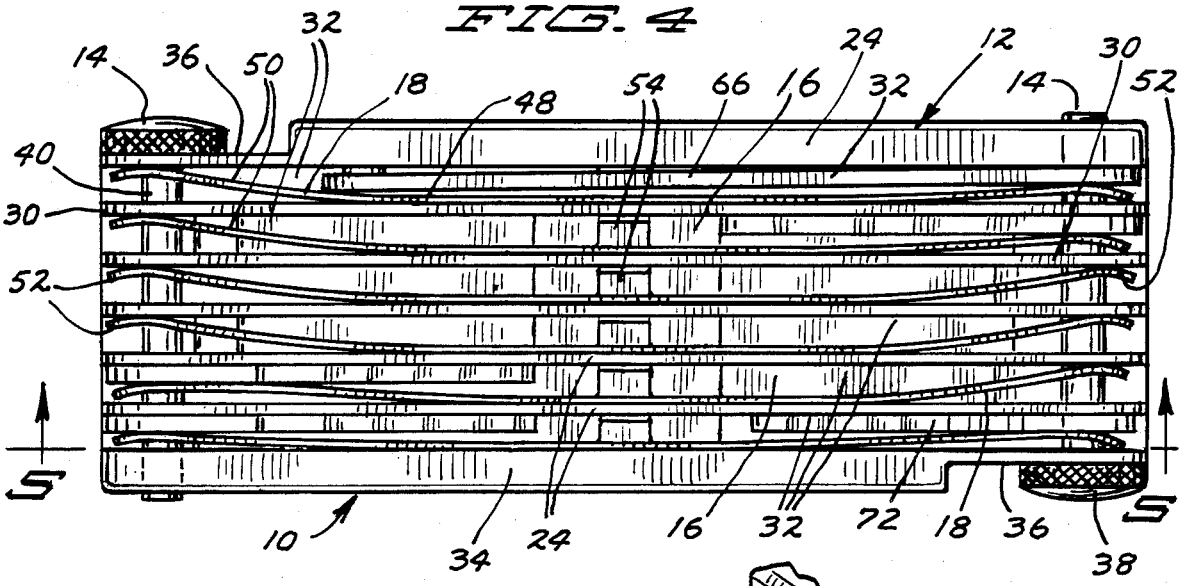
FIG. 5
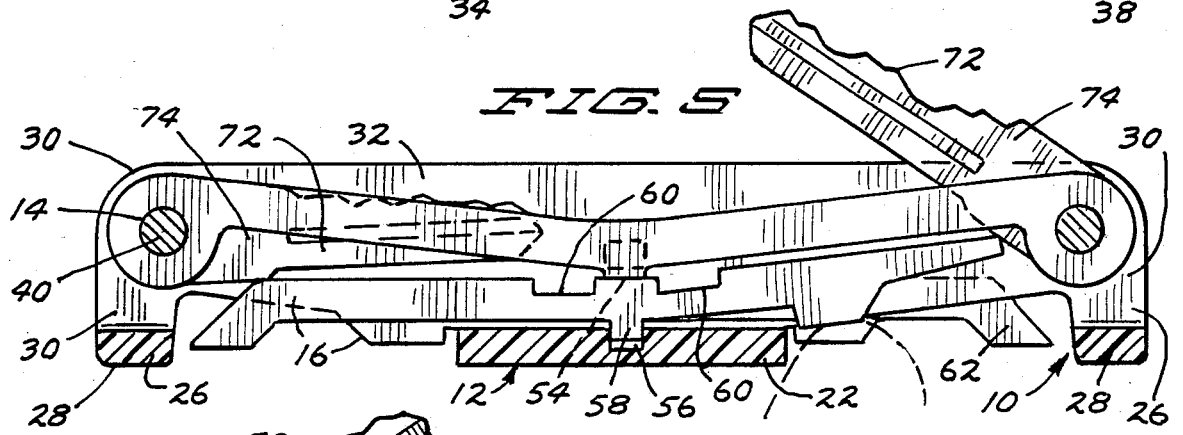
FIG. 6
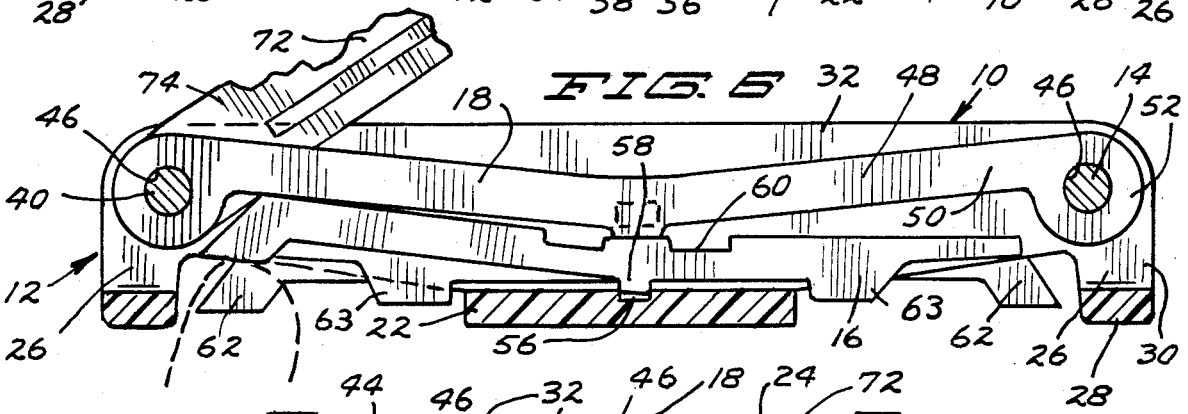
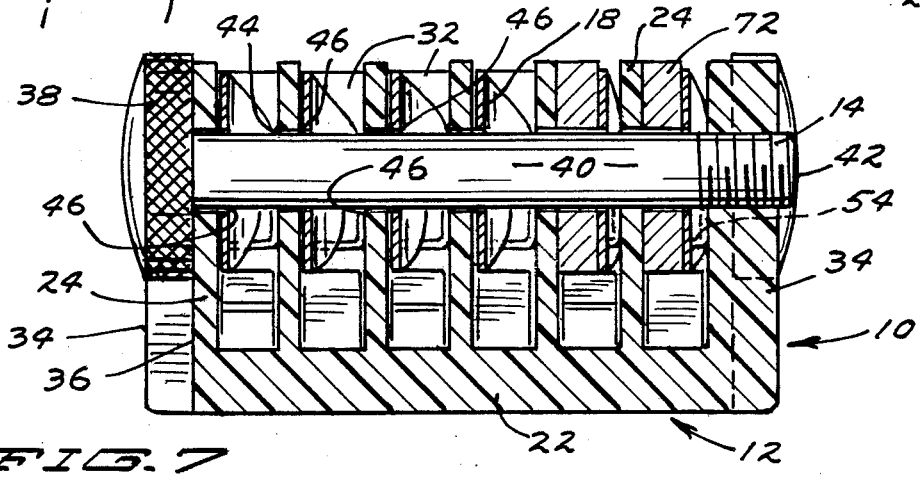
FIG. 7

KEY PACK

This is a continuation-in-part of application, Ser. No. 518,408, filed July 29, 1983, now abandoned.

BACKGROUND OF THE INVENTION

1. Field of the Invention

This invention relates to key packs or key holders for storing a plurality of keys or other flat, relatively thin and wide, elongated articles; such holders including means for selectively accessing one particular key from the plurality of keys.

2. Description of the Prior Art

Keys are often carried on key rinlgs, and people such as watchmen often attach these rings by chains to their belts or some other portion of their clothing, while others with perhaps less keys per ring carry them in their pockets or purses. The abrasive action of such keys on rings is similar to that of the constantly rotating hammermill, and pocket and purse linings are rapidly worn out when the person carrying the keys is at all active.

Keys are also often carried in leather or plastic key cases with a considerable number of keys each fastened to its own resilient hasp, and with the resilient hasps pivotally mounted with respect to a flat rectangular key hasp holding plate which is permanently mounted at one end of the key case. Such key cases usually include two front flaps which can be snapped or a side flap which can be zipped to encompass the keys within the case.

These methods of carrying keys and other methods suffer from the difficulty that it is hard to distinguish and to separate one key from the other without making a visual inspection and then without having to visually recognize a particular key for a particular lock by the shape and, sometimes, by the position of the key in the case or on the ring. If somewhere between 6 and 12 keys are to be carried by a single user, and/or if two or more of the keys are designed to go into the same brand of lock, it is virtually impossible to identify quickly each of the keys from all of the others, time after time after time.

On Nov. 13, 1954, Russell T. Wing, one of the co-inventors of the present key pack, together with Dodge E. Wing, were awarded U.S. Pat. No. 2,695,511 for a KEY HOLDER in which keys were pivotally mounted in a casing for moving between a stored position inside the casing and an access position outside of the casing. The keys were accessed by swinging a pivotally mounted selector plate to the right or to the left until it was aligned with the desired key and then, by pressing on a finger grip causing an ejector to push against the key from one side to cause it to swing up to an access position on the other side of the key holder. A plurality of flexible separators were utilized to be deflected to allow individual keys to be placed between adjacent separators, and semi-spherical elements secured to the separators were used to pass through openings in the heads of the keys to pivotally support the keys in the key holder. This structure proved workable, but since the keys were not positively locked or held firmly in position, the keys tended to become dislodged while other keys were being added or removed. Also, the structure of the Wing et al patent provided no way to positively identify keys in situations where the identification had to be made in the dark. Further, once the proper key was selected and ejected, the key was free to flap about in an unmanageable manner making it difficult to apply the key to a lock and to rotate the key in the lock once it was inserted.

SUMMARY OF THE INVENTION

A key pack or key holder for storing, selecting and using flat, relatively thin and wide, elongated articles such as keys having blade ends and having head ends that are not appreciably wider than the blade ends. Such a key holder includes a casing having a base wall and a plurality of parallel, rigid, spaced-apart, elongated, article compartment side walls, each side wall being integral with the base wall and extending outwardly therefrom at right angles to it and also extending longitudinally in direction from the base wall parallel to the general plane of the base wall. In the form of the invention as shown, at least one casing slotted end wall is provided and includes outer end portions of the side walls and a solid end bar joining and integral with each of these side wall outer end portions. The invention can be made to operate satisfactorily without the solid end bar.

Means is provided for pivotally mounting the keys or other articles adjacent the casing slotted end wall through the instrumentality of a key head opening in each key or other article adjacent a head end thereof. The keys, when so mounted, are movable between a storage position wherein the keys are entirely within the casing to a position for use extending outwardly from the casing.

A plurality of article movement fingers are mounted, one between each adjacent pair of casing article compartment side walls, and each finger is of a size and configuration to have a first finger edge portion thereof lying in adjacent relation to at least one key or other article when the key is in its storage position, each finger being mounted for pivotal movement with respect to the casing between a normal finger rest position and a finger operative position in contacting interfering relation to its adjacent key to cause it to move from its storage position toward its position for use. Each such finger is provided with at least one operating extension or button which extends outwardly from edges of the key compartment side walls, and each operating button is of size and configuration such that manual movement of the button in direction toward the side wall causes the article movement finger to push its key from its storage position toward its position for use.

A plurality of article position retaining means are situated one between each pair of article compartment side walls. In the form of the invention as shown, such means takes the form of a plurality of leaf springs. Each leaf spring is positioned to bear against a key or other article to force that key or article against one of such side walls whether the key blade is between the compartment side walls or not. The force of the leaf spring on the key and consequently the force of the key on its opposite compartment side wall causes enough friction to sustain the key in whatever position it is placed by the user.

In our parent application, a number of patents were cited which now become part of the prior art statement.

A special search for the details of this invention has not been made, but applicants and those in privity with them are aware of no prior art which is closer than that discussed above or cited in the parent application and are aware of no prior art which anticipates the claims herein.

BRIEF DESCRIPTION OF THE DRAWINGS

FIG. 4 is a plan view of the key holder of the invention with the base wall of the key holder casing underneath;

FIG. 5 is a sectional view taken on the line 5—5 in FIG. 4 showing a key at the right end of the key holder being moved from storage position toward position for use;

FIG. 6 is a vertical sectional view also taken on the line 5—5 in FIG. 4, but showing a key to the left in FIGS. 5 and 6 being moved from its storage position toward its position for use;

FIG. 7 is an enlarged sectional view taken on the line 7—7 in FIG. 3;

DETAILED DESCRIPTION OF THE PREFERRED EMBODIMENTS

Figure 1:
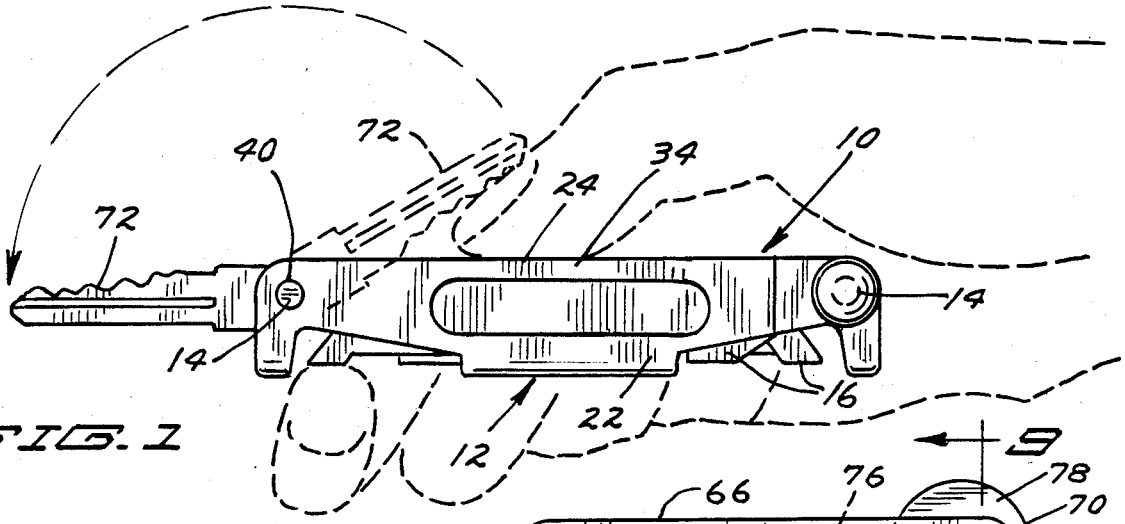
FIG. 1 is a side elevational view of a key pack or holder made accordng to a first form of the invention, showing a key in condition for use and showing in dotted lines that key being moved from a storage position toward a position for use.

A key pack or holder 10 is for storing, selecting and using keys or other relatively thin and wide, elongated articles which can be pivotably mounted therein on an axes transverse to plane at their widest dimension. The holder includes a casing 12, a pair of knurled cap screws 14,14 for mounting keys or similar articles in the casing, a plurality of key movement fingers 16 mounted in the casing, and a plurality of key position retaining, friction providing, leaf springs 18 mounted inside of the casing 12 on the cap screws 14.

The key casing 12 includes a flat base wall 22, a plurality of mutually parallel, rigid, spaced-apart, elongated key compartment side walls 24, each integral with the base wall and extending outwardly from it in normal relation to it and also extending in longitudinal direction away from the base wall in both directions in generally parallel relation to the general plane of the base wall. In the form of the invention as shown, the casing 12 also includes a pair of slotted end walls 26,26, each consisting of a solid end bar 28 and outer end portions 30 of the side walls 24 which are integral with the end bar 28.

As can perhaps best be seen from FIGS. 5 and 6, the diameter of these semi-circular outer end portions 30 of each of the side walls 24 is only slightly larger than the diameter of the truncated head portions 74 of each of the keys 72 installed in the key holder 10. As is common knowledge, the width of the blade end portions of keys in common usage today is in the neighborhood of 5/16" to ½". Accordingly, it has been found that an excellent embodiment of this invention can be constructed if the diameter of the semi-circular outer end portions 30 of the walls 24 is held to not less than ⅜" and not to appreciably more than ½".

The solid end bar 28 helps to insure that the key compartment side walls 24 do not deform in direction toward each other due to the lateral stresses placed thereon. However, when the material and the thickness of the side walls is properly selected and designed, a key holder 10 of the invention can operate satisfactorily without either solid end bar. These end bars, positioned as seen in the drawings, also serve to protect accidental access to the outer and inner operating extensions or buttons 62 and 63, respectively; and serve to protect the material of a pocket or purse in which the device is stored from being abraded by such buttons.

Figure 3:
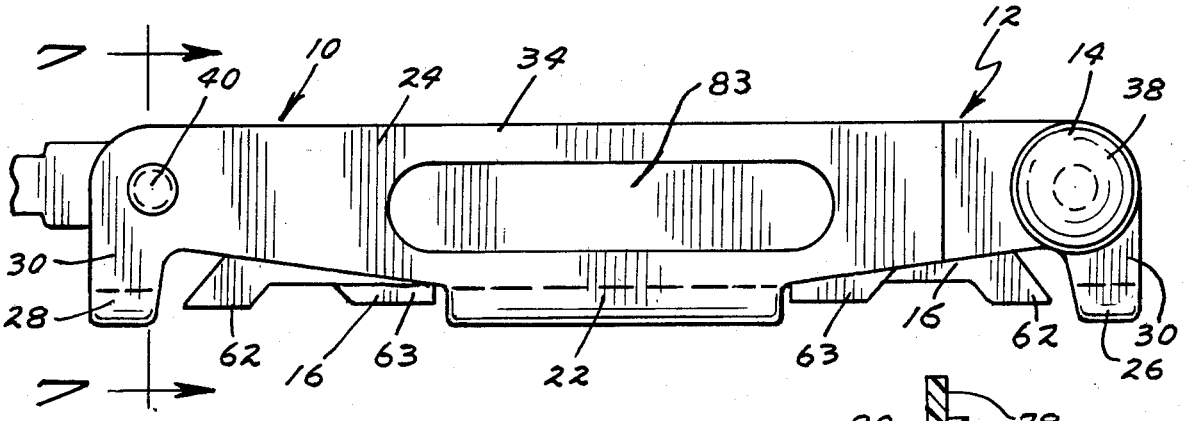
FIG. 3 is a side elevational view of the key holder as seen in FIG. 1 to the scale of FIG. 2.

While the key holder 10 of the invention is shown herein as being double-ended, that is as having a plurality of keys fastened adjacent each slotted end wall 26, it is to be understood that by having the plurality of parallel, spaced-apart, elongated key compartment side walls such as 24 extend only in one direction, for example, to the left in FIGS. 3, 5 and 6, a much more compact key holder will result and will be useful for persons having only a lesser number of keys to be carried and used.

In the main form of the invention as shown herein, adjacent side walls 24 define a plurality of parallel key compartments 32. In this form of the invention, each key compartment can carry two keys or other relatively thin and wide, elongated articles.

Figure 2:
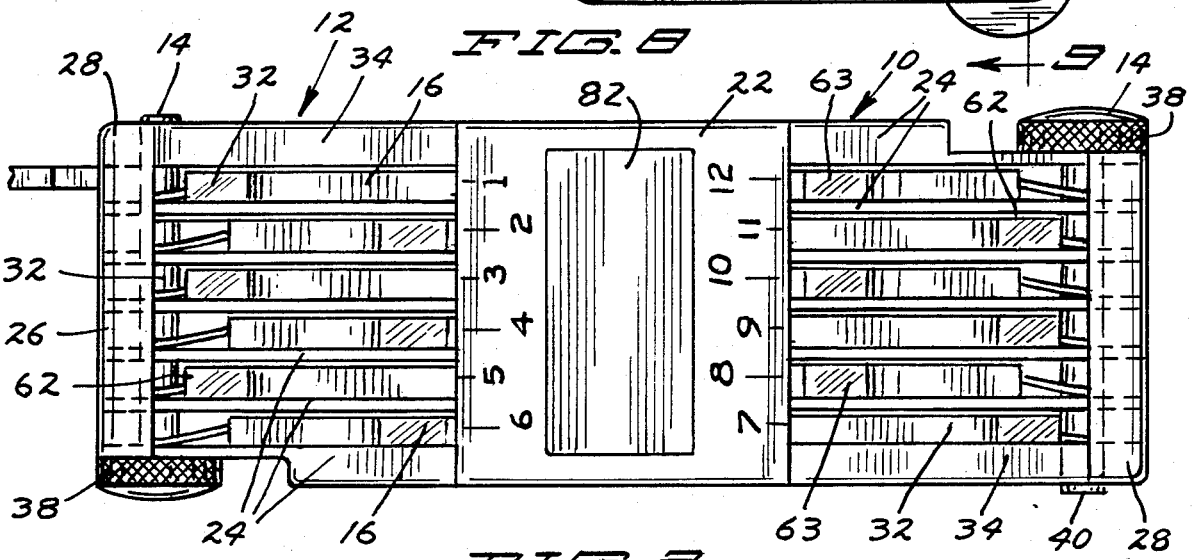
FIG. 2 is an enlarged plan view of the key holder of FIG. 1 with a base wall of a key holder casing uppermost.

As best seen in FIGS. 2 and 4, outermost key compartment side walls 24 are of substantially greater thickness than the inner key compartment side walls, and these outer walls are also designated 34,34. As perhaps best seen in FIGS. 2 and 4, one outer end portion 36 of each of these outer key compartment side wall is cut away to provide a clearance for a knurled head 38 of one of the cap screws 14. The cap screw 14 is also provided with a shank 40 having a threaded outer end portion 42. Cap screw receiving openings 44 are provided through each of the slotted end walls 26, and the cap screw receiving opening 44 through each outer key compartment side wall 34 at the end which has not been cut away is provided with threads to receive the threaded outer end portion 42 of each cap screw shank 40.

When the key holder of the invention is first sold, and before there are any keys assembled thereon, a leaf spring 18 is found situated in each key compartment 32. Each leaf spring is provided with a pair of cap screw receiving openings 46 therein, and is fastened in place by the cap screws 14,14. As best seen in FIG. 4, the leaf springs, viewed on edge, tend to take a very flat, but generally U-shape form. Each spring includes a relatively flat center portion 48, upwardly flaring end portions 50,50 and downwardly flaring outer ends 52,52 extending integrally outwardly from the end portions 50,50.

Seen in plan, each relatively flat center portion 48 of each leaf spring 18, as best seen in FIGS. 5 and 6, extend upwardly from its middle toward the outer end portions 50,50. The middle of each flat center portion 48 includes a key movement finger holddown tab 54 extending integrally from the center portion 48 generally at right angles to the flat plane of the body of the leaf spring 18.

The base wall 22 of casing 12 is provided with a transversely extending key movement finger retaining slot 56. Each key movement finger 16 includes at the center thereof a retaining boss 58 of dimension to fit inside of and to be retained by the retaining slot 56. See FIGS. 5 and 6. A first edge portion of each of the key movement fingers 16 is provided with a first finger edge portion lying in adjacent relation to a key when the key is in its storage position. Each key movement finger also is provided with a pair of reduced area necks 60,60, for the purpose of allowing outer end portions of each key movement finger 16 to flex with respect to the center portion thereof.

In the form of the invention as shown, a second finger edge portion of each of the key movement fingers 16 is provided with an outer operating extension or button 62, and an inner operating extension or button 63. These fingers 16 are assembled in the casing 12 so that each outer operating extension or button is situated in a key compartment 32 adjacent the inner operating extension or button 63 of its adjacent key movement finger(s).

The various parts or elements of key holder 10 can be made out of a number of different kinds of materials; but in one form, the casing 12 can be made of a firm and unyielding plastic, the cap screws 14 and the leaf springs 18 can be made of metal, and the key movement fingers 16 can be made of a slightly resilient plastic.

Figure 8:
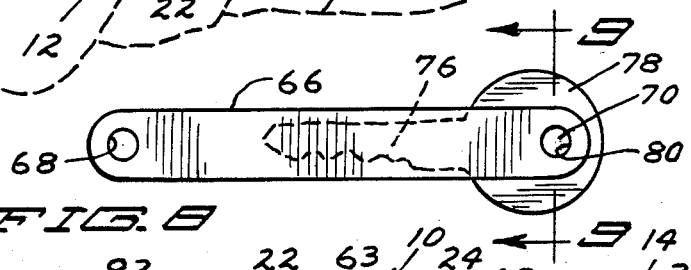
FIG. 8 is a plan view of a key forming template which can be nominally carried in the key holder of the invention and temporarily removed to trim the head of a key preparatory to mounting the key in the key holder, the key template being shown in overlying relation to a key to be trimmed.
Figure 9:
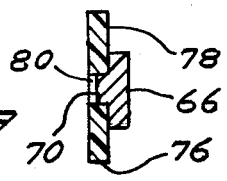
FIG. 9 is a sectional view taken on the line 9—9 in FIG. 8.

When the key holder 10 of the invention is first purchased for the ultimate user, it will not, of course, have on it the personal keys of the user. However, it can be provided with a key template 66 having a head end and a blade end such as is shown in plan in FIG. 8. This template 66 can have a cap screw receiving opening 68 through its head end so that it can be positioned in one of the key compartments 32 such, for example, as the right-hand end of the top compartment as seen in FIG. 4. As seen in FIG. 9, template 66 is provided with a short key positioning boss 70 which is not sufficiently long enough to prevent the template from taking its position in its key compartment 32 when being stored.

The key pack or key holder 10 of the present invention is designed to be used with special keys having truncated heads and not with ordinary keys which must have sufficiently wide heads to provide the user with a sufficient grip to turn the key in a hard-to-operate lock. With a key held in an operative position in a key holder of the invention and then inserted into a lock, rotating of the key holder itself provides several times as much leverage or mechanical advantage as can be obtained using a hand held ordinary key.

It is to be expected that as the present key holder 10 initially finds its place in the market, special keys 72 with truncated head portions 74 will not be readily available. This is the reason that key template 66 can be mounted in or furnished with the key holder 10. Then when the purchaser obtains key holder 10 from a key maker, the key maker can take each of the purchaser's ordinary keys 76 with full head portions 78 and machine, grind, or file them down to size such as is shown in FIGS. 5 and 6, for example.

In order to do this, the key maker will lay an ordinary key 76 on top of key template 66 with positioning boss 70 extending into a key head opening 80 and then fasten the assembled template 66 and ordinary key 76 in a vice where he can use a grinder or a file to remove those portions of the keyhead 78 which extend outside of the template, thus to fashion a key such as key 72 usable in the key holder 10.

Each key compartment 32 can be assigned a number as an aid to identification of the key therein and, as seen in FIG. 2, this number can be inscribed on the outer surface of the base wall 22 in such a manner as to indicate whether the numbered key can be accessed by pushing on an outer operating extension or button 62 or an inner button 63.

After each key 72 has been prepared, in order to load them into key holder 10, those keys to be associated with key numbers 1 through 6 are installed by removing the cap screw 14 to the left as seen in FIGS. 1, 2, 4, 5 and 6. Truncated head portion 74 of key to be numbered 1, for example, is slid between the leaf spring 18 and its spaced-apart key compartment side wall 24 in adjacent relation to the center portion 48 of the leaf spring, and slid to the left as seen in FIG. 4 to position the key head opening 80 thereof in alignment with the cap screw receiving openings 44 and 46 of the slotted end wall 26 and leaf spring 18, respectively. The friction furnished by the leaf spring 18 between its adjacent key compartment side walls 24 will keep the key from being unintentionally displaced, and will so maintain the key 72 and specifically its truncated head portion 74 in position so that the key head opening 80 and the cap screw receiving openings 44 and 46 remain in alignment even as keys 2 through 6 are similarly positioned in their key compartments. When all of the keys to be installed on that side of the key holder are in position, the cap screw 14 will be repositioned through all of the openings 44, 46, and 80 and the cap screw will be turned down to fasten the threaded outer end portion 42 of its shank 40 in the uncut key compartment side wall 34.

Keys or other similar flat articles such as the key template 66 can be installed in the opposite end key compartments designated 7 through 12 in a similar manner.

The tension of the key position retaining, friction providing, leaf springs 18 is such that whenever one or the other of the cap screws 14 is partially or entirely removed in order to insert or replace a key, the leaf springs will hold themselves and the other keys aligned with the cap screw receiving openings 44 and the key head openings 80 in fixed position within the casing 12 until such time as the desired change is made and the cap screw is once again replaced.

At least as important, each leaf spring 18 will exert sufficient pressure on the key or keys in its key compartment to provide all the friction needed to hold each key in any position around its cap screw into which the user has placed it. This makes it possible to position a key in alignment with the longitudinal axis of the casing and, holding only the casing, line the key up with a lock and insert it therein. The casing can then be rotated 90° with respect to the key in the lock and it will then be in a position to exert all the force needed to positively turn the key in the lock.

But first, in order to select and eject a particular key, for example, the key designated as key situated to the left in the first key slot as seen in FIGS. 5 and 6, the left end of the key movement finger 16 aligned with that key must be raised in upward direction as seen in FIGS. 5 and 6 to contact the key and push it from its storage position part way out of the key case to the access position shown in dotted lines in FIG. 1 where it can be manually pivoted to position for use as seen, for example, in full lines in that figure. To accomplish this, the outer operating extension or button 62 of that key movement finger 16 will be identified by sight (where light is available) or by touch and position and counting (where the key must be accessed in the dark). Once located, the extension button 62 will be moved from the position as seen in FIG. 5 on the left-hand side to the position as seen in FIG. 6 by using one of the fingers of one hand. This will deflect finger 16 and cause it to contact that particular key 72 to lift it from the position as seen in FIG. 5 to the position as seen in dotted lines in FIG. 1 and in full lines in FIG. 6. The key can then be moved to position for use.

To access key such as key 12, the inner operating extension or button 63 at the opposite end of the same key movement finger 16 will be deflected in direction toward the casing, (see FIG. 2) thus causing that particular end of the key movement finger 16 to move from its rest position as seen in FIG. 6 to its operative position as seen in FIG. 5. In FIG. 6, the right-hand key 72 has been removed for clarity of illustration; but in FIG. 5 it is shown in its accessed position, having been forced there by the upward movement of the right outer end portion of the key movement finger 16. When once so accessed, it, too, can be pivoted over to a convenient position for use.

In each case, once the key has been used for its intended purpose, it can be swung manually back into its stored position completely within the casing 12. The tension provided by the leaf springs 18 will, in every case, cause each key to remain in its position of rest, either partly accessed, in position for use, or in its storage position wherever it ends up or is released from action by the fingers of the user or by movement of the flexible key movement finger 16.

Modification can be made in the double-ended form of the invention as shown in the drawings without departing from the spirit of the invention. For example, in order to provide an easy identification of the end of the key holder holding keys identified by key compartments 1 through 6 as opposed to the end of the holder identifying compartments 7 through 12, the slotted end wall 26 and particularly its solid end bar 28 can be omitted at one end of the key holder, thus leaving the key compartment side walls 24 including their outer end portions 30 to provide the cap screw receiving openings 44, the end portions 30 being rounded off to roughly conform to the head end of the keys to be mounted thereon. Then the key operator, if operating in the dark, can simply feel for the one remaining solid end bar 28 and thus identify the end of the holder having compartments 1 through 6; knowing that the end of the holder not having the solid bar 28 identifies the end of the holder associated with compartments 7 through 12.

As seen in FIGS. 2 and 3, recessed panels 82 and 83 can be provided for displaying instructions, return address of a user, an advertising message, or any other desired intelligence.

Although the present invention has been described with reference to preferred embodiments, workers skilled in the art will recognize that changes may be made in form and detail without departing from the spirit and scope of the invention.

What is claimed is:

1. An apparatus for storing, selecting and using a plurality of flat, relatively thin and wide keys, said keys having a blade end and a head end, and said keys each being provided with a key head opening adjacent its head end; said apparatus including:

A. a casing having
  (1) a base wall, and
  (2) a plurality of fixed, parallel, rigid, spaced-apart elongated key compartment side walls, each side wall being integral with the base wall and extending outwardly from it in normal relation to it and extending in longitudinal direction from the base wall parallel to the general plane of the base wall, each pair of adjacent side walls partially defining a key compartment;

B. means for pivotally mounting a plurality of keys adjacent longitudinally extending outer end portions of the side walls for movement of the keys from a storage position in a key compartment within the casing to a position for use extending outwardly of the casing;

C. a plurality of key movement fingers, one mounted in each key compartment, each finger being of size and configuration to have a first finger edge portion lying in adjacent relation to at least one key when such key is in its storage position, each finger being mounted for limited movement with respect to the base wall between a normal finger rest position adjacent to said one key and a finger operative position in contacting relation to such key to cause the key to move from its storage position toward its position for use, and each finger being provided with at least one operating extension extending from a second finger edge portion on an opposite edge of the finger from the first edge portion, said finger operating extensions each nominally extending outwardly from edges of the key compartment side walls which are adjacent said base wall, and each operating extension being of size and configuration such that manual movement of any such extension in direction toward said key compartment side walls will cause its key movement finger to contact and to move a key in its compartment from said storage position toward said position for use;

D. each operating extension of each key movement finger being so spaced from the other extensions that manual movement of one extension in direction toward the side walls will not cause any other extension to move in such direction;

E. wherein said means for mounting said keys includes said key head opening in each key, mounting pin receiving openings through outer end portions of said casing key compartment side walls, and a mounting pin adapted to be removably installed in said key head openings and said pin receiving openings;

F. wherein a plurality of key position retaining and friction providing leaf springs are situated one in each key compartment, each leaf spring having a retaining pin opening provided through at least one end thereof, each said leaf spring being of configuration to press against the surface of a first side wall defining its key compartment and to press a key mounted in said compartment against the surface of a second side wall defining the opposite side of the compartment;

G. wherein the key compartment side walls extend from the base wall in two opposite longitudinal directions in parallel relation to the general plane of the base wall;

H. wherein there is provided means for pivotally mounting a plurality of said keys adjacent to each set of longitudinally extending end portions of the side walls for movement between storage positions and positions for use;

I. wherein each leaf spring is provided with a pin retaining opening at each end thereof and is adapted to be positioned in its key compartment by removably installed mounting pins extending through said leaf spring pin receiving openings in each end thereof;

J. wherein said base wall is provided with a transversely extending key movement finger retaining slot at a side thereof adjacent the key movement fingers;

K. wherein each key movement finger is provided with a key movement finger retaining boss extending centrally downwardly therefrom in position to fit into said base wall retaining slot; and L. wherein each leaf spring is provided with a centrally positioned key movement finger holddown tab extending outwardly from a central portion of the leaf spring in position to contact the key movement finger and to hold it down with its retaining boss situated in the base wall retaining slot.

2. The apparatus of claim 1 wherein:

M. each leaf spring is generally U-shape in edge view, and extends from a relatively flat center portion in contact with and pressing against a first side wall of the key compartment to a pair of upwardly flaring outer end portions, each outer end portion contacting a second opposite side wall when no key installed and contacting an installed key to press it against the second side wall, said outer end portion contacts being made in the general vicinity of the leaf spring key receiving opening.

3. The apparatus of claim 1 wherein:

N. each leaf spring includes a relatively short downwardly flaring outer end portion integral with and extending outwardly from the upwardly flaring end portions.

4. An apparatus for storing, selecting and using flat, relatively thin and wide elongated articles adapted for pivotal mounting at one end thereof to move in the plane of the thin dimension; said apparatus including:

A. a casing having (1) a base wall, and (2) a plurality of fixed, rigid, parallel, spaced-apart, elongated, article compartment side walls, each side wall being integral with the base wall and extending outwardly from it in normal relation to it and extending in longitudinal direction from the base wall parallel to the general plane of the base wall, each pair of adjacent side walls partially defining an article compartment;

B. means for pivotally mounting at least one of said articles adjacent a longitudinally extending outer end portion of at least two of the side walls for movement of the article from a storage position in an article compartment within the casing to a position for use extending outwardly from the casing;

C. a plurality of article movement fingers, one mounted between each adjacent pair of casing article compartment side walls, each finger being of size and configuration to have a first finger edge portion lying in adjacent relation to at least one article when such article is in its storage position, each finger being mounted for limited pivotal movement with respect to the base wall between a normal finger rest position adjacent to said one article and a finger opertive position in contacting relation to such article to cause the article to move from its storage position toward its position for use, and each finger being provided with at least one operating extension extending from a second finger edge portion on an opposite edge of the finger from the first finger edge portion, said finger operating extensions each nominally extending outwardly from edges of said article compartment side walls which are adjacent said base wall, and each operating extension being of size and configuration such that manual movement of any such extension in direction toward such side walls will cause its article movement finger to contact and to move an article in its compartment from said storage position toward said position for use;

D. wherein said flat, relatively thin and wide elongated articles are constituted as:

(1) a plurality of keys each having a blade end and a head end, each key being provided with a key head opening adjacent its head end, and (2) at least one key template having a head end and a blade end, the blade end being provided with a cap screw receiving hole at an outer end portion of the blade end and a key positioning boss and extending outwardly from one face of its head end; and E. wherein the profile of the head end of the key template being such that when the key template is removed from the apparatus for storing articles and situated against a key with the template key positioning boss inserted in a key head opening of the key, with the blades of the key template and key in overlying parallel relationship to each other, then the removal of all portions of the key head outside of the template head will shape the key so that it will lie entirely within the casing after it has been installed in the apparatus for storing articles.

* * * * *